US007237736B1

(12) United States Patent
Martin

(10) Patent No.: US 7,237,736 B1
(45) Date of Patent: Jul. 3, 2007

(54) GRINDER PUMP WITH SELF ALIGNING CUTTER ASSEMBLY

(75) Inventor: Jay D. Martin, Oklahoma City, OK (US)

(73) Assignee: Little Giant Pump Company, Oklahoma City, OK (US)

( * ) Notice: Subject to any disclaimer, the term of this patent is extended or adjusted under 35 U.S.C. 154(b) by 23 days.

(21) Appl. No.: 11/294,236

(22) Filed: Dec. 5, 2005

(51) Int. Cl.
*B02B 1/00* (2006.01)
*B02C 13/00* (2006.01)

(52) U.S. Cl. ..... 241/46.06; 241/185.6

(58) Field of Classification Search ..... 241/46.06, 241/185.6, 290
See application file for complete search history.

(56) References Cited

U.S. PATENT DOCUMENTS 3,650,481 A * 3/1972 Conery et al. ..... 241/46.11
4,108,386 A 8/1978 Conery et al.
4,378,093 A 3/1983 Keener
4,454,993 A 6/1984 Shibata et al.
4,697,746 A * 10/1987 Nishimori ..... 241/46.017
4,911,368 A * 3/1990 Nishimori ..... 241/46.017
5,016,825 A 5/1991 Carpenter
5,044,566 A 9/1991 Mitsch
6,010,086 A * 1/2000 Earle et al. ..... 241/46.11
7,159,806 B1 * 1/2007 Ritsema ..... 241/46.06

* cited by examiner

*Primary Examiner*—Faye Francis
(74) *Attorney, Agent, or Firm*—Fellers, Snider, et al.; Bill D. McCarthy

(57) ABSTRACT

A grinder pump with a self aligning cutter assembly, the grinder pump having an inlet port, a drive shaft and a cutter assembly, the cutter assembly comprising a rotary cutter and a stationary, annular cutter. The rotary cutter is supported for rotation by the drive shaft, and the annular cutter is supported in the inlet port. The rotary cutter has a pair of primary knife members with knife edges, and the annular cutter is supported in the inlet port, the annular cutter having a central bore in which a plurality of internal cutting edges are formed. The rotary cutter is supported in the central bore so its primary knife members are rotated in operational cutting engagement with the internal cutting edges by the drive shaft. The annular cutter is provided a limited range of radial movement and is positioned within the range of movement by the rotary cutter.

11 Claims, 5 Drawing Sheets

GRINDER PUMP WITH SELF ALIGNING CUTTER ASSEMBLY

BACKGROUND OF THE INVENTION

1. Field of Invention

The present invention relates generally to grinder pumps, and more particularly but not by way of limitation, to a grinder pump having a self aligning cutter assembly that produces effective and efficient grinding of influent materials.

2. Discussion

Grinder pumps are known in the art for grinding large solid or semisolid materials in a liquid media to form a slurry which is pumped by the pump. A typical grinder pump has an axial inlet communicating with a pumping chamber, and its motor driven shaft extends through the pumping chamber into the inlet. Mounted on a proximal end of the shaft is a rotary cutting disk having a plurality of peripheral cutting edges. An annular, ring shaped cutting member is supported at the pump inlet, axially aligned with the motor driven shaft. The shaft supports and rotates the rotary cutting disk within the ring shaped annular cutting member to effect the grinding action of the pump. An example of such a pump is disclosed in U.S. Pat. No. 5,016,825 issued to Carpenter.

The configuration of the rotary cutting disk and the ring shaped annular cutting members initially, and over the life of these members, effectively determines the effectiveness and the efficiency of a grinder pump in performing the grinding function. Generally, the closer in spatial juxtaposition that the cutting edges of a grinder pump can be maintained, the better the cutting and shearing of solids that can be achieved. Also, the better the cutting yields, the lower is the amperage draw of the pump motor; the less occurrence of relay reengagements; and the less time required to grind the solids.

Along these lines, fibers and stringy materials are known to cause difficulties for grinder pumps because such materials present relatively small cross sections and are not readily engageable by the cutting surfaces. This is especially true as cutting wear causes greater radial separation of the cutting edges of the rotary and annular cutters. Further, the realities of achieving tight manufacturing tolerances between cutting edges make it very difficult and expensive to achieve close radial separation of the cutting surfaces when the pump is initially manufactured, and maintaining close radial separation during the operational life of the grinder pump is problematic at best.

There is a need for a grinder pump having very close radial separation of the cutting edges of the cutter assembly, both initially and during the operating life of the grinder pump. It would also be desirable to achieve such close radial separation by means that will provide cost effective manufacturing and maintenance over a long operational life.

SUMMARY OF THE INVENTION

The present invention provides an improved grinder pump that has a self aligning cutter assembly, the grinder pump having an inlet port and a drive shaft. The cutter assembly comprises a rotary cutter and a stationary, annular cutter. The rotary cutter is supported for rotation by the drive shaft, and the annular cutter is supported in the inlet port. The rotary cutter has a pair of primary knife members that have knife edges, and the annular cutter has a central bore in which a plurality of internal cutting edges are formed. The rotary cutter is supported in the central bore of the annular cutter, and the primary knife members and the internal cutting edges are in operational cutting engagement.

To provide the annular cutter a limited range of radial movement, the annular cutter has indexing grooves that are engaged loosely by the tabs of a retaining ring that is mounted to the grinder pump volute casing over the inlet port, thus allowing some radial movement of the annular cutter. Thus, when the rotary cutter is disposed to extend into cutting engagement with the annular cutter, the annular cutter can float, or self align, with radial deviation or movement of the rotary cutter on the drive shaft.

The advantages and features of the present invention will be apparent from the following description when read in conjunction with the accompanying drawings and appended claims.

BRIEF DESCRIPTION OF THE DRAWINGS

FIG. 6 is an enlarged edge view of a portion of the stationary cutter of the self aligning cutter assembly of FIG. 1. FIG. 6A is an enlarged edge view of one of the slots of the stationary cutter.

DESCRIPTION

The self aligning cutter concept of the present invention is based upon the basic concept that the closer that cutting edges can be maintained to each other in a grinder pump, the more effective and efficient cutting and shearing of solids that are caused to pass through the cutter. This in turn yields lower amp loading of the motor rotating the cutter, attendant lesser relay reengagements and minimum grinding time.

The industry standard for grinding pump cutters consist of two cutting members that cooperate to perform the grinding or cutting. One cutting member is rotational while the other cutting member is annular. The rotating cutter is mounted to a rotor shaft, usually by threads. Typically, the rotor shaft is supported by a pair of spaced apart roller bearings that are mounted at an upper end and at a lower end, with the roller bearings supported by the motor housing and a lower bearing plate, respectively. The annular cutter is usually secured in the volute housing that is typically mounted to the lower bearing plate.

Each of the described components has manufacturing, or machine, and concentricity tolerances which typically have to be considered in determining the clearances between the cutter edges. It is common for the industry to allow 0.010 to 0.020 inch diametrical clearance between the edge of the rotating cutter and the annular cutter. This has been necessary to allow for machining tolerances and concentricity of the motor housing, shafts, lower bearing mounting plate, volute housing and assembly. In contrast, in the present invention, the cutter clearance between the rotating cutter and the annular cutter is not constrained by the achievable manufacturing concentricity tolerances; therefore, the cutter clearance in the present invention is negligible to ensure optimal shearing and cutting action.

The self aligning cutter of the present invention operates by allowing the annular cutter to axially align and float with the rotating cutter; that is, the annular cutter is permitted some freedom of radial movement within the volute. This allows the spatial position of the rotating cutter to be established by the drive shaft, while the spatial position of the non-rotational cutter is determined, within the range of radial movement permitted, by the rotational cutter. Thus, the rotating cutter and the non-rotational, annular cutter can move together radially to compensate for TIR (Total Indicator Reading related to Total Runout) and component concentricity tolerances.

Specially designed notches are provided at intervals about the non-rotational, annular cutter to help pull material into the cutters, and to provide for rotational interrupt of the cutter blades, thereby effecting self-clearing of the blades. This will be discussed more fully herein below.

Figure 1:
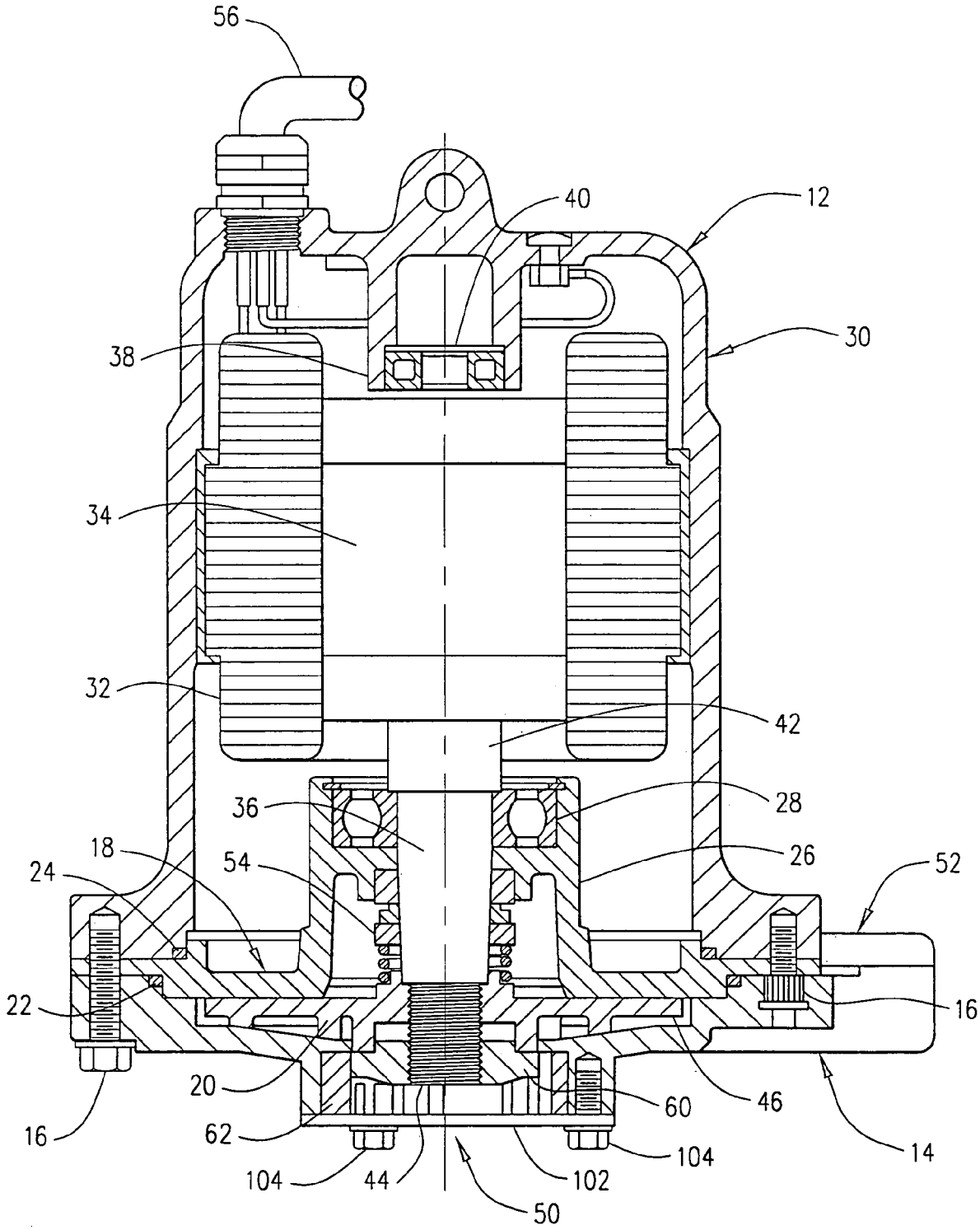
FIG. 1 is a cutaway, elevational view of a grinder pump with a self aligning cutter assembly constructed in accordance with the present invention.

Referring now to the drawings in general, and in particularly to FIG. 1, shown therein is a grinder pump 10 constructed in accordance with the present invention. FIG. 1 is a cross-sectional, partial detailed view in which some of the structural details need not be described in detail as such structure will be apparent to one skilled in the art of grinder pumps. Further, the same number designations will be maintained throughout the following discussion for better clarity.

The grinder pump 10 has a motor housing 12 and a volute casing 14, and a number of bolts 16 serve to connect the volute casing 14 to the lower end of the motor housing 12. A seal plate assembly 18 has a seal plate 20 that is disposed to be secured between the lower end of the motor housing 12 and the seal plate 20, and appropriate seal members 22 and 24 (preferably O-ring seals) are disposed to be compressed between abutting surfaces of the seal plate 20, the motor housing 12 and the volute casing 14, as depicted.

The seal plate assembly 18 has an upwardly extending center section 26 that has a recess cavity into which is pressed a lower bearing 28. The motor housing 12, identified above, is part of a motor 30, which also comprises a stator 32 that is supported along the inner wall of the housing 12. The motor 30 has a rotor 34 that is supported by a drive shaft 36 in the motor housing 12.

Integral with the housing 12 is a bearing support intruding portion 38 having a recess cavity into which is pressed an upper bearing 40 which is disposed in axial alignment with the lower bearing 28. An upper end (not separately designated) of the drive shaft 36 is supported by the upper bearing 40, while a shouldered lower medial portion 42 is supported by the lower bearing 28. A threaded lower end 44 of the drive shaft 36 supports a pump impeller 46 in a volute chamber 48 that is formed between the seal plate 20 and the volute casing 14. The volute chamber 48 communicates with an inlet port 50 and an outlet port 52, and a conventional seal mechanism 54 seals about the drive shaft 36 to prevent fluid from entering the interior of the motor housing 12.

A power cord 56 extends through an appropriately sized aperture/grommet seal into the motor housing 12 and connects to the stator 32 in a conventional fashion, the details of which, being known to those skilled in the art, need not be described herein.

A cutter assembly 58 is supported in or near the inlet port 50 formed by the volute casing 14 as will now be described. The cutter assembly 58 has a rotary cutter member 60, described more fully below, that has a threaded bore and is mounted on the threaded portion 44 of the drive shaft 36. The cutter assembly 58 also has a non-rotational, or stationary, annular cutter member 62 supported in the inlet port 50 of the volute casing 14 in the manner that will be described herein below.

Figure 2:
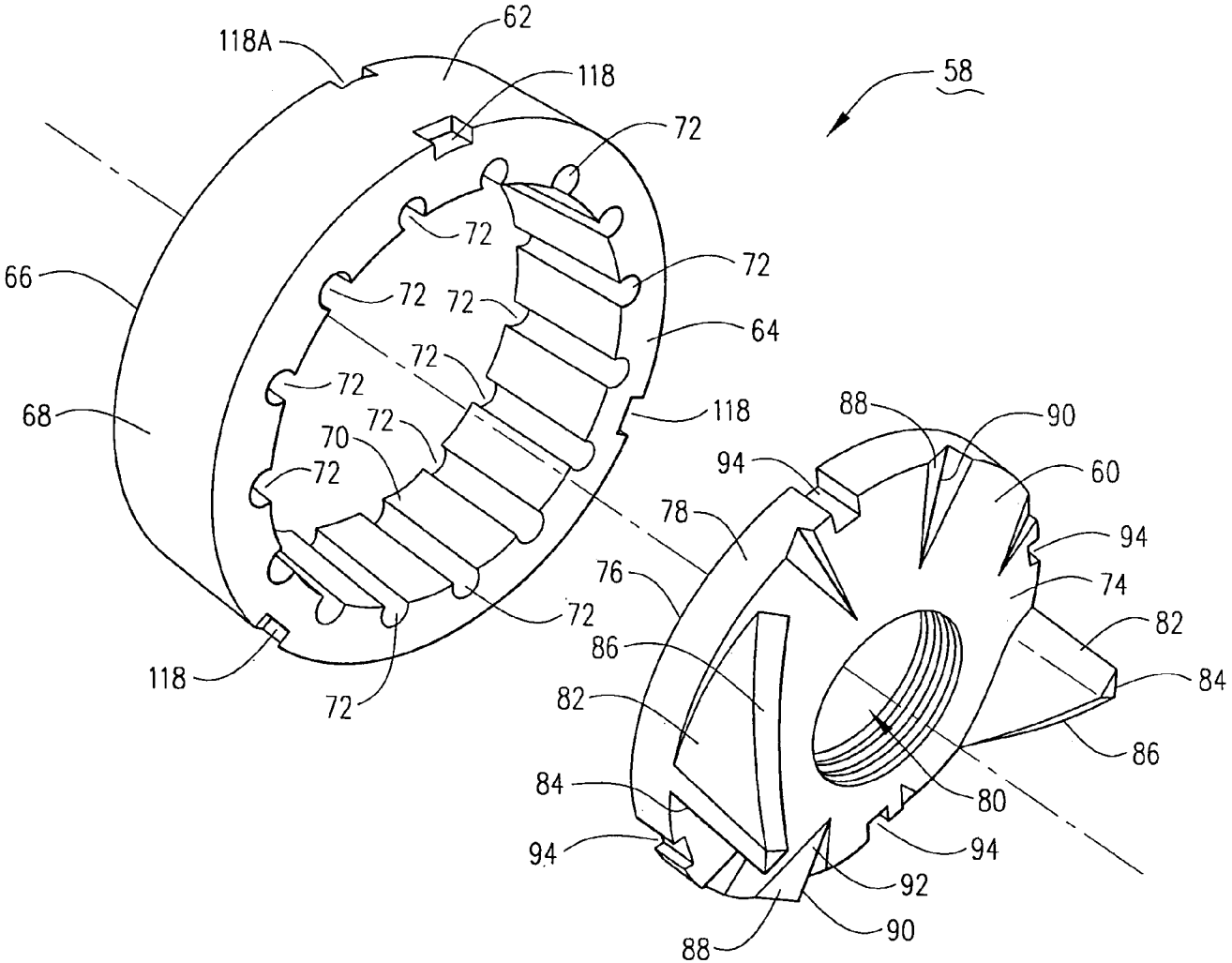
FIG. 2 is an exploded view of the cutter assembly of FIG. 1.

FIG. 2, having the components of the cutter assembly 58 in exploded position, shows the cutter assembly to be comprised of the rotary cutter 60 and the non-rotational, annular cutter 62. Dealing first with the latter mentioned component, the annular cutter 62 is a ring shaped member having a first edge 64, a second edge 66, an outer circumferential surface 68 and an inner circumferential surface 70. A plurality of slots 72 are formed along the inner circumferential surface 68 and extend between the first and second edges 64, 66.

The rotary cutter 60 is a disk shaped member having a first edge 74, a second edge 76 and an outer circumferential surface 78. The rotary cutter 60 is dimensioned to be supported in, and axially aligned with, the central bore of the annular cutter 62 so that its outer circumferential surface 78 is in close, clearing relationship to the inner circumferential surface 70.

The rotary cutter 60 has a threaded central bore 80 dimensioned to receive the threaded lower end 44 of the drive shaft 36, and thus mounted, the rotary cutter 60 will have a fixed relationship to the drive shaft 36.

The rotary cutter 60 has a pair of integrally formed primary knife members 82 protruding from the first edge 74 and positioned at diametrically opposed locations thereon so as to balance the rotary cutter 60 about its central axis. Each knife member 82 has a leading sharpened knife edge 84 and a rear portion 86 that tapers toward the first edge 74, curving inward from the outer circumferential surface 78 for relief therefrom.

The rotary cutter 60 also has a pair of integrally formed secondary knife members 88 diametrically opposed on the first edge 74 and equidistantly spaced between the primary knife members 82. Each secondary knife member 88 has a leading, sharpened knife edge 90 and a rear portion 92 that tapers toward the first edge 74.

The rotary cutter 60 is preferably provided with four equidistantly spaced apart notches 94 about its periphery as shown. The four notches 94 in the rotary cutter 60 help hold onto a material, such as a rag, while cutting and pulling the material into the pump volute; that is, the notches serve to grip the material, not allowing it to fall away from the cutters. Also, the notches 94 provide an interval of interruption along the cutting edges so that material tending to jam the cutters is cleared, the notches thus acting in the manner of annular cutter teeth that are self-clearing.

Figure 3:
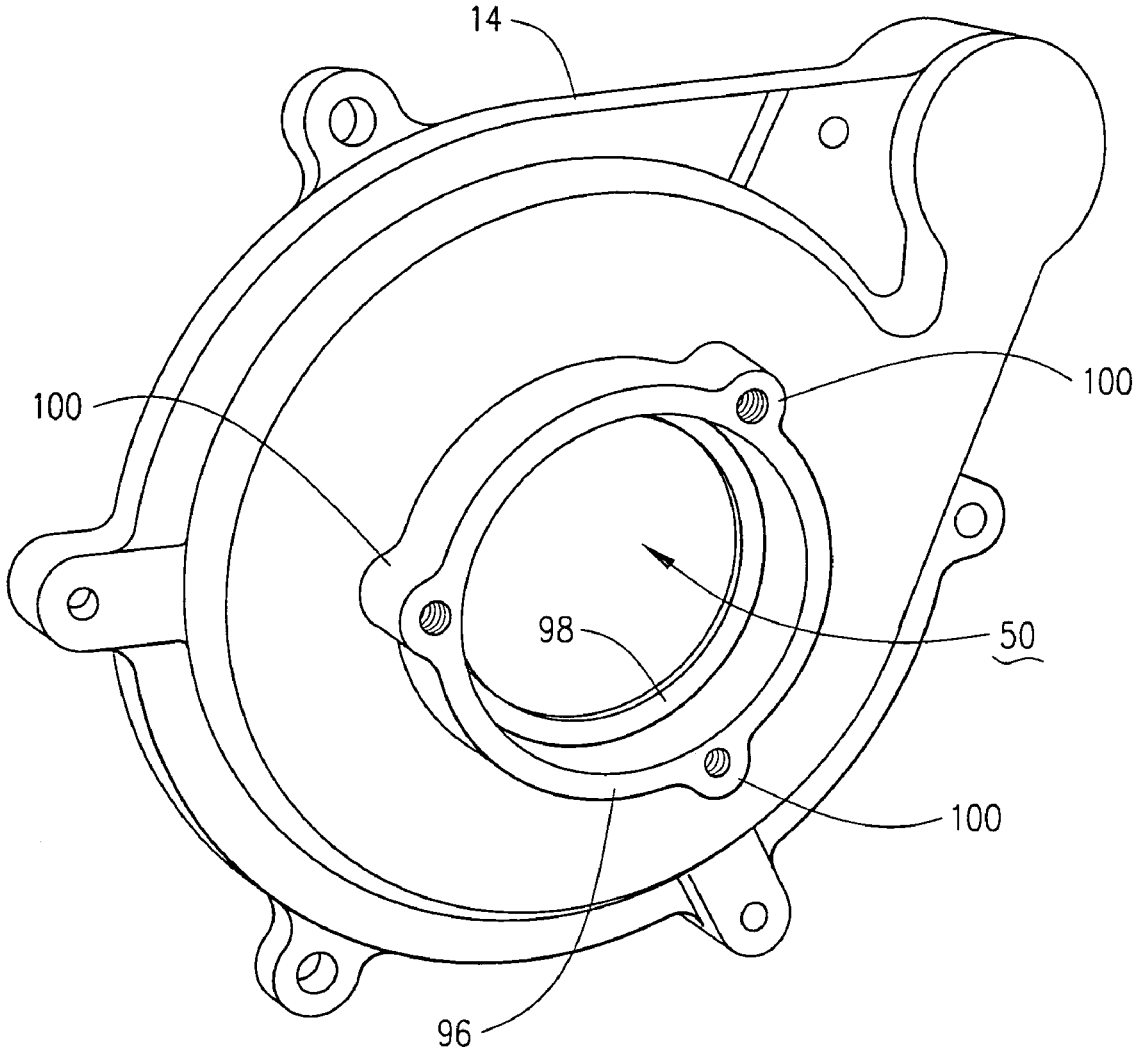
FIG. 3 is a perspective, under view of the volute casing of the grinder pump of FIG. 1.

Referring to FIG. 3, the underside of the volute housing 14 reflects the inlet port 50 as having a raised, integral ring portion 96 and a support shelf 98 recessed in the inlet port 50, the ring portion 96 having an internal circumferential surface 99. Formed about the body of the volute housing, and integral therewith, are support boss portions 100, the boss portions having bolt-receiving bores (not separately designated) that align with companion, threaded bores in the bottom of the motor housing 12 for attachment thereto. In FIG. 1, the annular cutter 62 is shown in the inlet port 50 and secured therein via a retaining ring 102 and bolts 104 engaged in the threaded bores of the boss portions 100.

Figure 4:
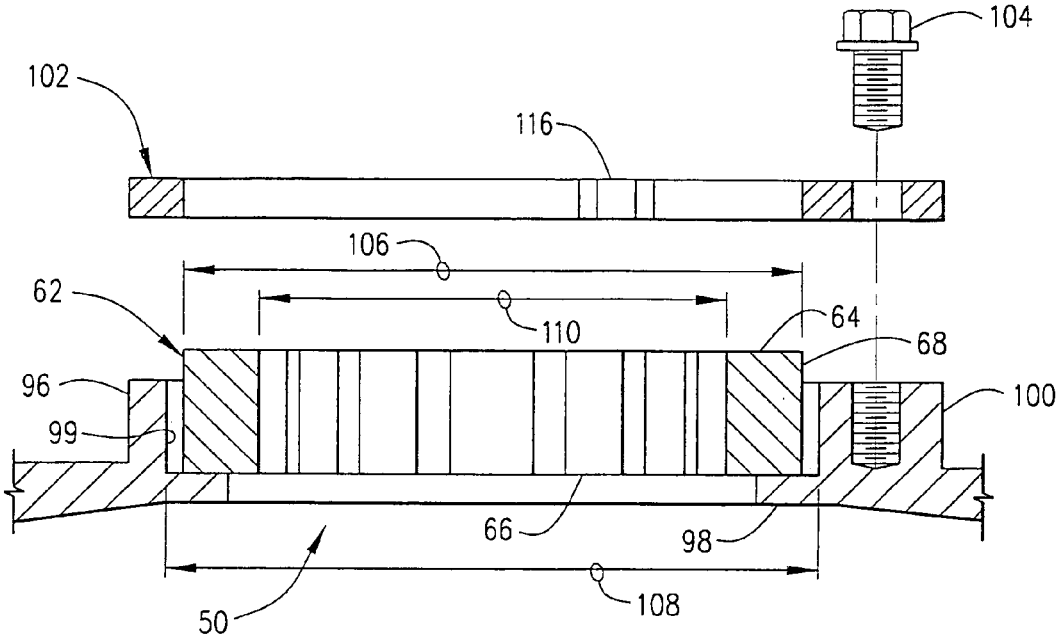
FIG. 4 is an elevational view in cross-section of the mounting of the stationary cutter of the self aligning cutter assembly of FIG. 1.

FIG. 4 shows, cutaway and inverted for convenience of reference, a portion of the volute casing 14 having the annular cutter 62 disposed in the inlet port 50 and supported on (or abutting against) the support shelf 98. The retaining ring 102, with one of the bolts 104, is depicted just prior to being brought to rest over the outer circumferential surface 68 of the annular cutter 62 during assembly when the retaining ring 102 is caused to abut the ring portion 96, thereby securing the annular cutter in the inlet port 50.

As depicted in FIG. 4, the outer diameter (depicted by arrow 106) of the annular cutter 62 is less than the inner diameter (depicted by arrow 108) of the ring portion 96 of volute casing 14. The gap (not numerically designated) shown between the diameters of the annular cutter 62 and ring portion 96 (that is, the gap between the outer circumferential surface 68 and the internal circumferential surface 99), is exaggerated to make the point that this gap clearance can be several thousands of an inch so the annular cutter 62 will readily slip into the ring portion 96 with some room to float. On the other hand, the outer diameter of the knife edges 84, 90 of he primary and secondary knife members 82, 88, respectively, and the inner diameter (depicted by arrow 110 in FIG. 4) of the annular cutter 62 can be tightly machined so that a clearance between the outer circumferential surface of the rotary cutter 60 and the inner circumferential surface 70 of the annular cutter 62 will be about a thousandth of an inch, which is much tighter spatial relationship than achieved by prior art grinder pump cutters.

Figure 5:
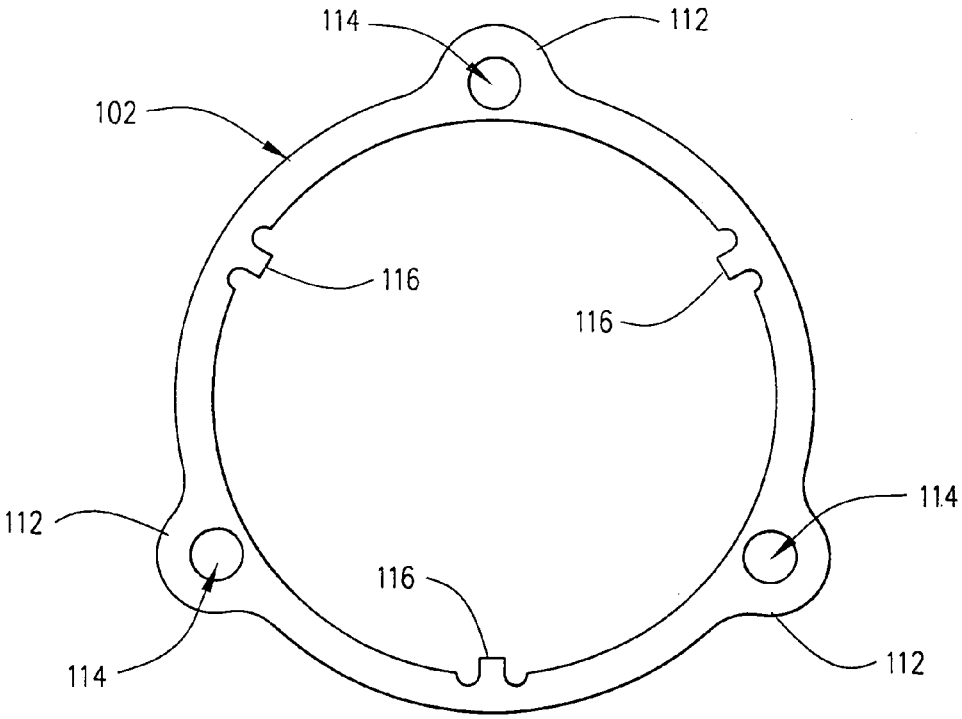
FIG. 5 is a plan top plan view of the retaining ring of FIG. 4.
Figure 5:
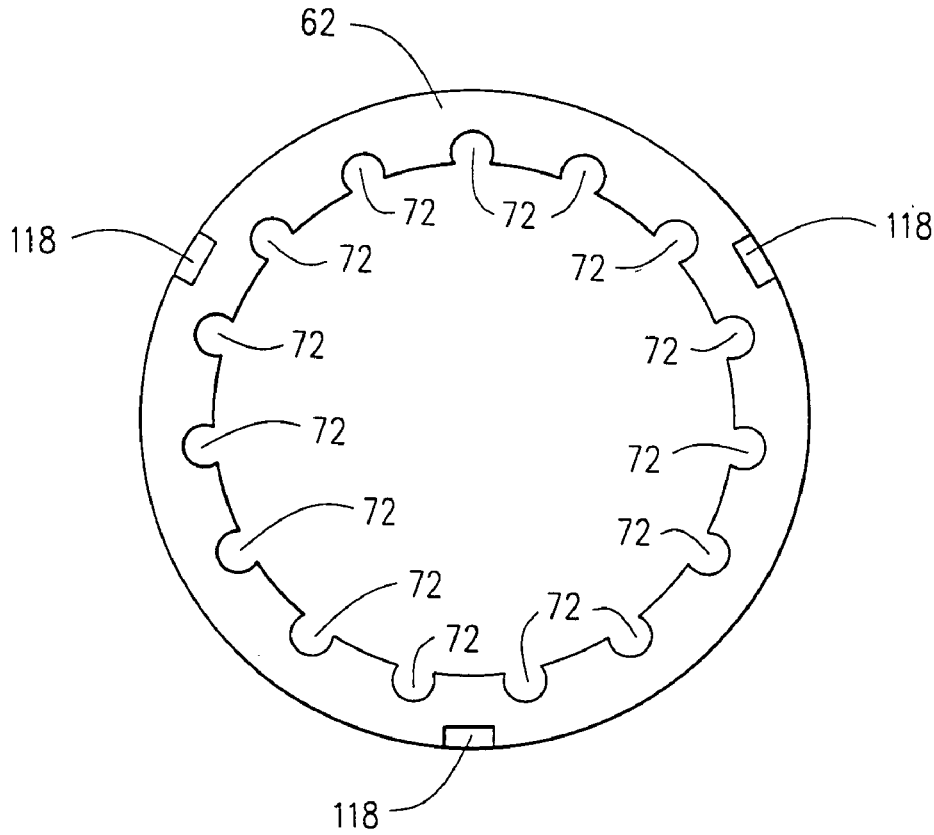
Figure 5A:
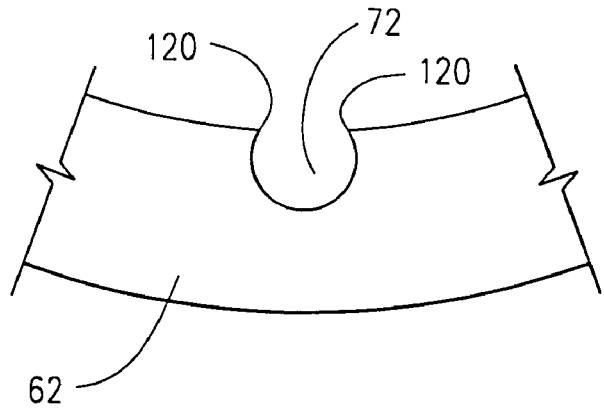

Turning to FIG. 5, the retaining ring 102 has three ear members 112 corresponding in size and position to the boss portions 100 of the ring portion 96 surrounding the inlet port 50. Each ear member 112 has a bolt hole 114 corresponding to the bores of the boss portions 100. Also, spaced about the inner circumference of the retaining ring 102 are three inwardly extending index tabs 116.

Returning to FIG. 2, it will be noted that the annular cutter 62 has three indexing grooves 118, corresponding in number to the index tabs 116 of the retaining ring 102 so that, when the retaining ring 102 is positioned over the annular cutter 62 in the manner illustrated in FIG. 4 (which shows the retaining ring in the process of being placed over the annular cutter), the index tabs 116 will align with, and be received in, the indexing grooves 118.

It will be noted that the indexing grooves 118 are cut into the first edge 64 and extend into the outer circumferential surface 68 of the annular cutter 62, thereby comprising a first set of indexing grooves. It is preferable that a second set of such indexing grooves be provided along the second edge 66; that is, three indexing grooves 118A are cut into the second edge 66 to extend into the outer circumferential surface 68 (only one the grooves 118A is visible in FIG. 2). While only one of these sets of indexing grooves can be used at a time, this arrangement permits the annular cutter 62 to be reversible.

Preferably, the thickness dimension of each index tab 116 corresponds to the depth of the indexing grooves 118, but the width dimension of each index tab 116 is determined to fit loosely in the width of the indexing grooves 118. Also, it is preferred that the thickness dimension of the annular cutter 62 will be greater than the dimension between the depth of the shelf 98 so that, when the annular cutter 62 is placed thereon, and the retaining ring 102 is placed there over and attached to the boss portions 100 via the bolts 104, the outer surface of the retaining ring 102 (relative to that shown in FIG. 4) will generally be flush with the first edge 64.

When the annular cutter 62 is thusly secured in the inlet port 50 on the recessed shelf 98 by the retaining ring 102, the annular cutter 62 will be restrained to have limited freedom of movement as determined by the width dimensions of the index tabs 116 relative to the indexing grooves 118. This, along with the gap between the outer circumferential surface 68 and the internal circumferential surface 99, permits the annular cutter 62 a limited range of freedom to move slightly, or that is, to float, within the stated dimensional restraints, so that the position of the annular cutter 62, within the restraints stated, will be determined by the position of the rotary cutter 60, thereby permitting very close fitting manufacturing tolerances between the rotary cutter 60 and the annular cutter 62.

Thus, a means is provided to support the annular cutter 62 on the pump inlet 50 while permitting a limited range of freedom of radial movement of the annular cutter 62 with the rotary cutter 60. It will be appreciated that the length of travel radially of the rotary cutter 60 within the inlet port 50 will be determined by the thickness of the gap between the outer circumferential surface 68 (of the annular cutter 62) and the internal circumferential surface 99 (of the ring portion 96), which is the difference between the inner diameter 108 and the outer diameter 106. Of course, the dimensions of the index tabs 116 and the indexing grooves 118 should be established to permit this full range of freedom of radial movement of the annular cutter 62.

FIGS. 6 and 6A are included to provide a closer view of the slots 72 that are cut in the inner circumferential surface 70 of the annular cutter 62 to extend between, and communicate with, the first and second edges 64, 66. Each slot 72 has a pair of internal cutting edges 120 that extend along the slot 72, the open slot 72 providing relief for its cutting edges 120.

Thus, the grinder pump 10 with the cutter assembly 58 is an improved grinder pump having self aligning cutter capability. The rotary cutter 60 of the cutter assembly 58 is rotated by the drive shaft 36 in cutting engagement with the annular cutter 62 that is supported on the volute casing 14 at the inlet port 50. The primary knife members 82 of the rotary cutter 60 are supported in the central bore 80 of the annular cutter 62 so the knife edges 84, 90 are in operational cutting engagement with the internal cutting edges 120.

The limited range of radial movement of the annular cutter 62 permits it to move with, or follow, the rotary cutter 60 while in cutting engagement, as the indexing grooves 118 are engaged loosely by the tabs 116 of the retaining ring 102 that mounts the annular cutter 62 to the grinder pump volute casing 14 in the inlet port 50. When the rotary cutter 60 is in cutting engagement with the annular cutter 62, the annular cutter 62 automatically aligns with radial deviation or movement of the rotary cutter 60 on the drive shaft 36.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. In combination with a grinder pump having a pump inlet port and a rotatable drive shaft, a cutter assembly comprising:

a rotary cutter supported by the drive shaft and having a primary knife member having a knife edge;

an annular cutter supported in the inlet port having a central bore and an internal surface, the internal surface configured to form a plurality of internal cutting edges, the annular cutter disposed so that the cutting edges are in cutting engagement with the knife edge of the rotary cutter; and means disposing the annular cutter on the inlet port and permitting limited radial movement of the annular cutter with the rotary cutter.

2. The cutter assembly of claim 1 wherein the grinder pump has a volute casing in which the inlet port is disposed, the volute casing forming a shelf, and wherein the means disposing the annular cutter on the inlet port comprises:

a retaining ring disposable about the annular cutter; and means attaching the retaining ring to the volute casing so that the annular cutter has a range of freedom of radial movement, the position of the annular cutter being determined by the position of the rotary cutter during cutting operation thereof.

3. The cutter assembly of claim 2 wherein the rotary cutter has a pair of primary knife members, and a pair of secondary knife members, each having a knife edge positioned to be in cutting engagement with the internal cutting edges of the annular cutter.

4. The cutter assembly of claim 3 wherein the annular cutter has a first edge and an outer circumferential surface, and wherein the annular cutter has a first set of indexing grooves extending from the first edge into the outer circumstantial surface, and wherein the retaining ring has a plurality of index tabs equal in number to the first set of indexing grooves, each of the index tabs engageable with one of the indexing grooves when the retaining ring is attached to the volute casing.

5. The cutter assembly of claim 4 wherein the annular cutter has a second edge, the annular cutter having a second set of indexing grooves extending from the second edge into the outer circumstantial surface, and wherein the index tabs of the retaining ring are engageable with one of the indexing grooves when the retaining ring is attached to the volute casing.

6. A grinder pump comprising:

a motor housing;

a volute casing mounted to the motor housing, the volute casing having an inlet port;

a motor supported by the motor housing and having a drive shaft extending into the inlet port;

a cutter assembly comprising:

a rotary cutter supported by the drive shaft and having a primary knife member having a knife edge;

an annular cutter supported in the inlet port having a central bore and an internal surface, the internal surface configured to form a plurality of internal cutting edges, the annular cutter disposed so that the cutting edges are in cutting engagement with the knife edge of the rotary cutter; and means disposing the annular ring member on the inlet port and permitting limited radial movement of the annular cutter with the rotary cutter.

7. The grinder pump of claim 6 wherein the means disposing the annular cutter on the inlet port comprises:

a retaining ring disposable about the annular cutter; and means attaching the retaining ring to the volute casing so that the annular cutter has a range of freedom of radial movement, the position of the annular cutter being determined by the position of the rotary cutter during cutting operation thereof.

8. The cutter assembly of claim 7 wherein the rotary cutter has a pair of primary knife members, and a pair of secondary knife members, each having a knife edge positioned to be in cutting engagement with the internal cutting edges of the annular cutter.

9. The cutter assembly of claim 8 wherein the annular cutter has a first edge and an outer circumferential surface, and wherein the annular cutter has a first set of indexing grooves extending from the first edge into the outer circumstantial surface, and wherein the retaining ring has a plurality of index tabs equal in number to the first set of indexing grooves, each of the index tabs engageable with one of the indexing grooves when the retaining ring is attached to the volute casing.

10. The cutter assembly of claim 9 wherein the annular cutter has a second edge, the annular cutter having a second set of indexing grooves extending from the second edge into the outer circumstantial surface, and wherein the index tabs of the retaining ring are engageable with one of the indexing grooves when the retaining ring is attached to the volute casing.

11. In combination with a grinder pump having a pump inlet member and a rotary drive shaft, a grinding assembly comprising:

a rotary cutter supported by the drive shaft and having at least one cutter blade having a cutting edge;

an annular cutter having a central bore and an internal surface, the internal surface configured to form a plurality of internal cutting edges, the annular cutter disposed so that the cutting edges are in cutting engagement with the cutting edge of the rotary cutter; and means supporting the annular ring member on the pump inlet member and permitting limited radial movement of the annular cutter with the rotary cutter.

* * * * *